United States Patent [19]

Paepke

[11] Patent Number: 5,003,659

[45] Date of Patent: Apr. 2, 1991

[54] CLEANING APPARATUS

[76] Inventor: Edwin E. Paepke, S3296 Fox Hill, Baraboo, Wis. 53913

[21] Appl. No.: 279,538

[22] Filed: Dec. 5, 1988

[51] Int. Cl.[5] ..... A47L 17/08

[52] U.S. Cl. ..... 15/209 D; 15/145; 15/209 B; 15/230.17; 15/244.1

[58] Field of Search ..... 15/209 R, 209 D, 210 R, 15/244.1, 244.2, 145, 160, 230.17

[56] References Cited

U.S. PATENT DOCUMENTS

| | | | |
|---|---|---|---|
| 3,090,064 | 5/1963 | Garrett | 15/209 D X |
| 3,284,832 | 11/1966 | McIver | 15/209 D |
| 3,302,232 | 2/1967 | Wasiloff et al. | 15/230.17 |
| 3,346,904 | 10/1967 | Armstrong | 15/230.17 |
| 3,590,414 | 7/1971 | Gores | 15/244.1 |
| 4,236,270 | 12/1980 | Mavis | 15/244.2 |
| 4,455,705 | 6/1984 | Graham | 15/244.2 |

FOREIGN PATENT DOCUMENTS

| | | | |
|---|---|---|---|
| 509602 | 3/1952 | Belgium | 15/244.1 |

*Primary Examiner*—Edward L. Roberts
*Attorney, Agent, or Firm*—Carl Gulbrandsen

[57] ABSTRACT

A cleaning tool comprising a base having a generally flat side and a handle structure for grasping by a human hand or for receiving an extrusion member for the handle. The base has a plurality of hook-like elements which cooperate with loop like elements on a cleaning element to attach the cleaning element to the base.

2 Claims, 3 Drawing Sheets

FIG. 1
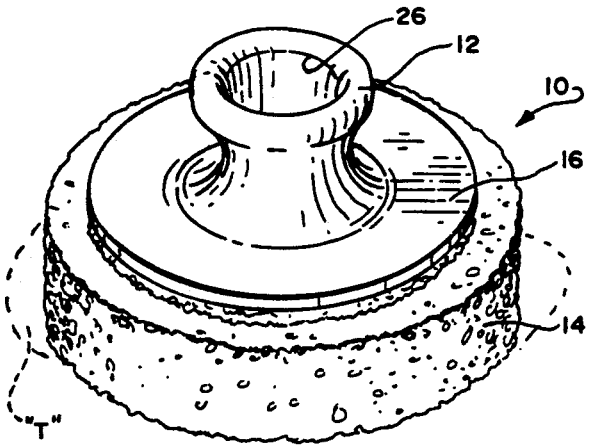
FIG. 2
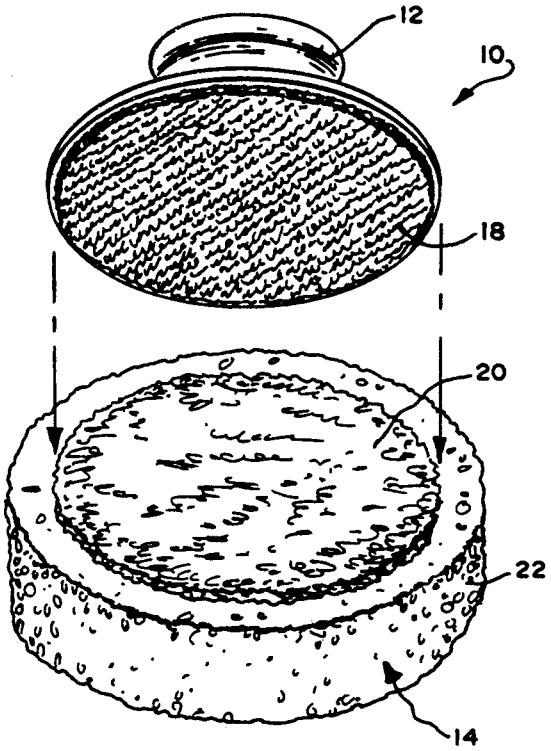
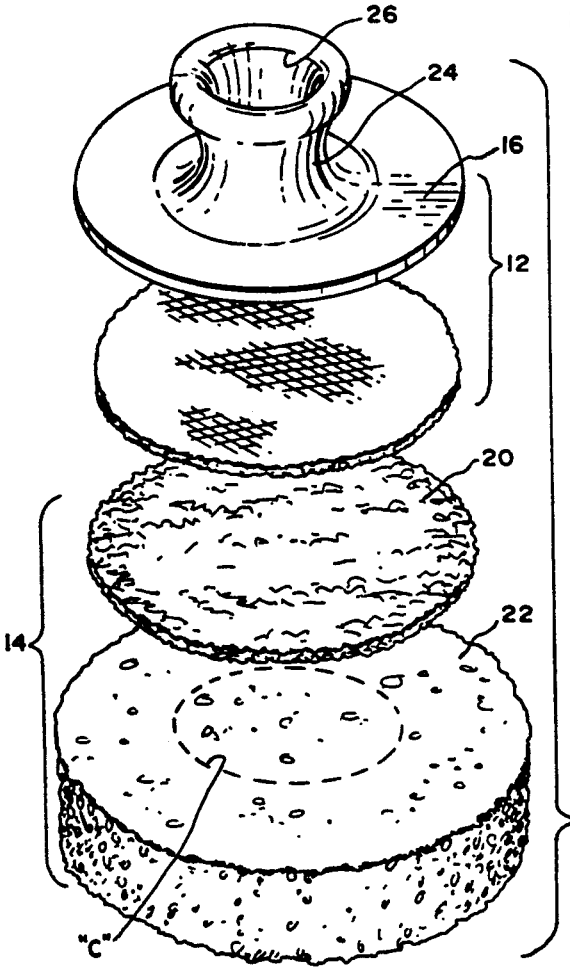
FIG. 3
FIG. 4
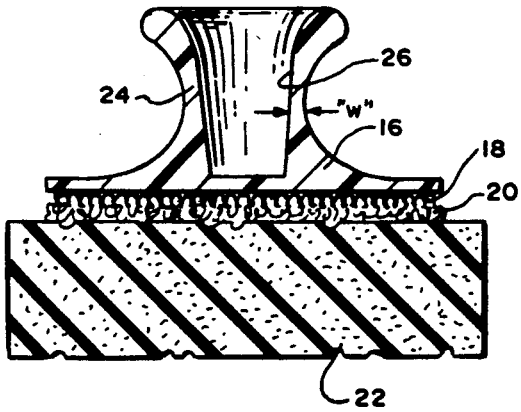

CLEANING APPARATUS

TECHNICAL FIELD

This invention relates to the general subject matter of hand tools and, in particular, to the subject of hand held cleaning implements, such as brushes and scrubbers.

BACKGROUND OF THE INVENTION

The task of cleaning and scrubbing is a day-to-day chore which continues to defy solution. No one has found a completely satisfactory tool. All scrubbing implements have some shortcomings. One of the most troublesome difficulties is that hand held commercially available scrubbing tools frequently are so poorly designed that they deteriorate in a short period of time or frequently cannot take heavy duty use without coming apart (e.g., the ordinary straw broom or synthetic kitchen sponge). If a tool is built strong enough for long service, it is all too often limited to a single purpose or task (e.g., a stainless steel wire brush). Another difficulty is that the portion of the tool which physically comes into contact with the surface to be cleaned (i.e., the working end or head of the tool) is usually not made to be replaced A replaceable element is quite useful to limit the carryover or spread of removed dirt or foreign matter to another object. Similarly, the means by which replacement elements are attached is often complex and requires the use of one or more small easy to loose threaded fasteners or special purpose connectors. Lastly, but by no means least, is the problem of the manner in which the human interfaces with the tool. Sometimes a long handle is useful; other times such a handle interferes with the cleaning task (e.g., cleaning containers with curved or flared sides or corners), or prevents the direct application of force to the surface to be cleaned.

Thus, there is a long felt need for improvements in the field of hand held cleaning brushes. Such a tool should be economical to manufacture, long lasting, and inexpensive. It should have one or more replaceable cleaning elements which are easy to remove and install and which do not fall apart. It should be one which can be easily gripped and one which has versatility as to its use and the surfaces which may be cleaned. It should also be one whose parts can be easily changed and one to which one or more attachments can be added. Such an implement will gain wide acceptance in the market place by virtue of its performance alone.

SUMMARY OF THE INVENTION

In accordance with the present invention, a cleaning apparatus is disclosed. Specifically, the cleaning apparatus comprises: a generally circular, plastic injection molded base having one flat side and an opposite side which is provided with means for grasping the base with a human hand, or an extension thereof; and means for attaching a cleaning means to the flat side of the base by using a plurality of hook-like elements which are carried by the base and which interface with looped elements of the cleaning means, or an extension thereof.

Several embodiments are disclosed. In certain specific embodiments, the base is provided with a removable plug-in extension handle and the cleaning means comprises a stainless steel loose curled sponge, or a water absorbent sponge to which a looped fastener fabric is attached. The plastic base is long lasting and durable. The hook and loop method of attachment does not require additional tools and eliminates the possibility of lost parts. The easy to attach extension handle adds versatility and a stainless steel cleaning head gives the user a means by which the toughest of cleaning chores can be tackled with confidence.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 1 is a perspective view of one embodiment of the cleaning tool that is the subject of the present invention;

FIG. 2 is a perspective view of the cleaning tool of FIG. 1 with the upper handle portion removed from the lower cleaning head;

FIG. 3 is an exploded assembly drawing of the tool in FIG. 1;

FIG. 4 is a cross-sectional side view of the tool shown in FIG. 1;

DETAILED DESCRIPTION OF THE INVENTION

Figure 5:
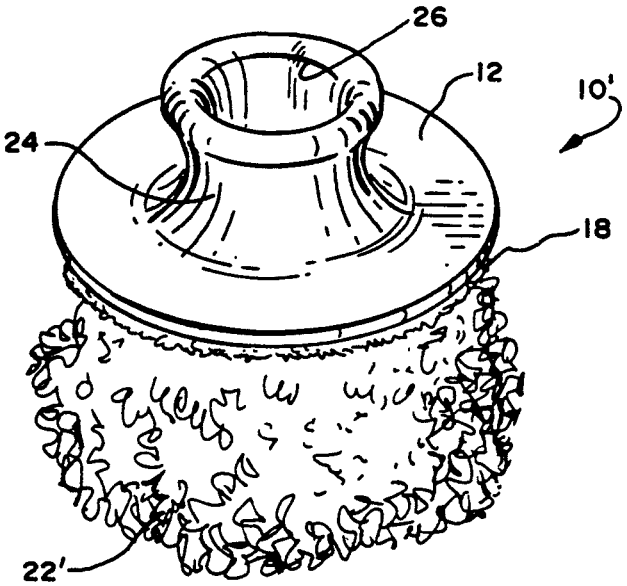
FIG. 5 is a perspective view of another embodiment of the cleaning tool that is the subject of the present invention.

While this invention is susceptible of embodiment in many different forms, there is shown in the drawings and will herein be described in detail several specific embodiments of the invention. It should be understood, however, that the present disclosure is to be considered as an exemplification of the principles of the invention and is not intended to limit the invention to the specific embodiments illustrated.

Turning to FIG. 1, there is illustrated one embodiment of the cleaning tool 10 that is the subject of the present invention. The cleaning tool 10 comprises a upper handle portion 12 and a lower cleaning head 14. The handle portion 12 comprises a generally flat circular or disk shaped base 16 and hook fastener means 18. The cleaning head 14 comprises loop fastener means 20 and cleaning means 22.

In this particular embodiment, the hook fastener means 18 is adhesively attached or glued to the flat under side of the base 16 and the loop fastener means 20 is adhesively attached to the upper surface of a water holding cleaning means 22, such as a household sponge. As such, the hook fastener means 18 and the loop fastener means 20 form a hook and loop removable fastener or self-gripping fastener. Such a fastener is commonly available under the Velcro trademark. In the Velcro fastener, multiple rows of small vertically extending open plastic loops are secured to the outer surface of a pair of matching strips, while matching small plastic hooks are secured to the outer surface of the opposite strip. Thus, when the two opposing strips are press-contacted (see FIG. 2), the hooks in one strip 18 link with loops in the opposite strip 20, so that the opposing parts adhere to each other (i.e, the flat surface of base 16 and the upper surface of cleaning means 22). Similarly, the base 16 can be separated from the cleaning means 22 by pulling them apart with sufficient force to cause the hooks to disengage from their corresponding loops.

Although commercial hook and loop fasteners may be more economical, it is envisioned that the hook means 18 may be an integral part of the base 16, in the sense of being formed when the base is formed or separately implanted into the base.

Turning now to FIG. 4, the upper part of the base 16 comprises a central member or knob 24. The central member 24 has a reduced diameter section intermediate its upper end or side and lower end or side. The reduced diameter section is rounded (see "R" of FIG. 8), so as to comfortably receive the thumb and first finger of the human hand. The knob or central member 24 and the adjacent flat portion of the base 16 provide an area for pressure to be applied by the user's hand. The central knob at the upper end of the member 24 is provided with a tapered aperture 26 (i.e., about 2 degrees) for adding extensions thereto (i.e., See FIG. 8 discussed later). Preferably, the base 16 has relatively thin walls "W" so that it may be formed from an injection molded plastic such as poly-styrene or Ethelene, or other high-impact plastic.

In the embodiment illustrated in FIGS. 1 through 4, the cleaning means 22 can be formed from a wide variety of materials. For example, it may comprise an ordinary household sponge or open cell foams or loose curl materials. The hook and loop self-gripping fasteners 20 and 22 provide an interface to attach virtually any cleaning material to the plastic base 16.

Figure 6:
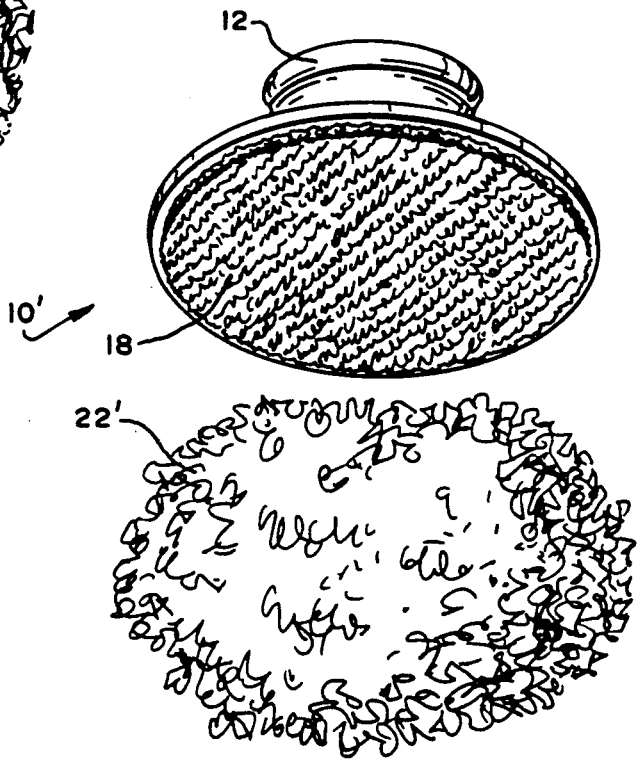
FIG. 6 is a perspective view of the cleaning tool of FIG. 5 with the upper handle portion removed from the lower cleaning head.
Figure 7:
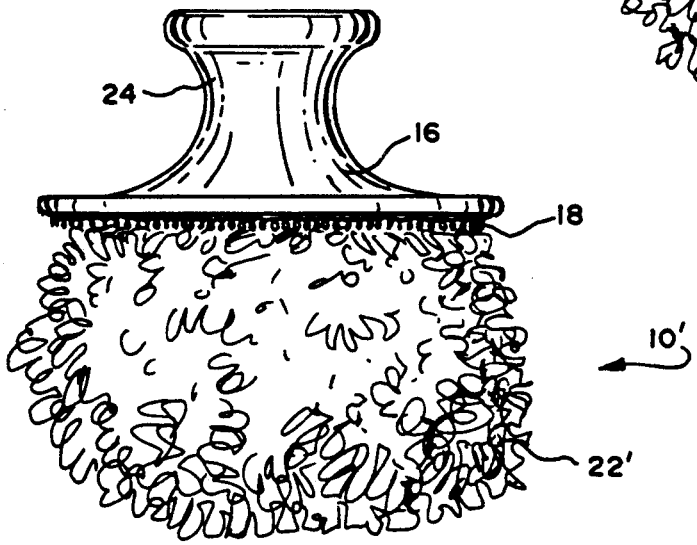
FIG. 7 is a side view of the tool shown in FIG. 5.

Turning now to FIGS. 5, 6, and 7, another embodiment of the invention is illustrated. In this particular embodiment, the cleaning head 14 is formed from material having a plurality of looped or curled filaments or members which are adapted to be captured by the hooks of the hook fastener means 18. There are several materials which can be used for this purpose. One example is a composition of metal turnings or copper scruble (or scruple). In the preferred embodiment, the cleaning means 22 comprises thin, wire-like strands of stainless steel, plastic, or other suitable material. The strands are interspersed in such a manner that a plurality of loops are formed which can be removably attached to the hook fastener means 18. The Montgomery Company of Windsor Locks, Conn., manufactures a 265 grain stainless steel loose curled sponge which grips most satisfactorily to No. 88 hook and loop Velcro material Similar sponge material may also be found under the Kurly Kate trademark or the Scrubble trademark. Sometimes the loose curled sponge is described by manufacturers as a "kettle scrubber" material. Other suitable materials are sponge formed of open cell plastic, such as poly-styrene. A synthetic sponge, referred to as "Water-C", may also be used. It also should be understood throughout that "sponge" is used in the general sense of a cleaning material; a water holding capability is not essential to the functioning of the scrubber tool.

Regardless of the source of material, or the particular nature and manner in which the members or elements of the cleaning means are formed, the spacing, size, and density of the hook fastener means 18 should be selected in such a manner that a good grip is formed so that the cleaning means is adequate for the scrubbing task to be performed. For example, for cleaning pots and pans and other common kitchen utensils, a medium grip should be adequate. When used for cleaning a barbecue grill or baked on grease, a tight grip should be used. In this regard, Velcro hook fastener means 18, using an arrowhead stitch or barb shaped hooks (vice J-shaped hooks), has been very good. Finally, a light grip should be adequate for light duty, such as in the case of a back scrub brush.

It also should be understood that the base 16 of FIGS. 5, 6, and 7 is identical to that of FIGS. 1 through 4. In other words, the same base may be used with a relatively abrasive cleaning means 22' or a softer cleaning means 22. Thus, the cleaning tool, which is the subject of the present invention, is truly a multi-purpose tool or a "multi-scrubber".

Figure 8:
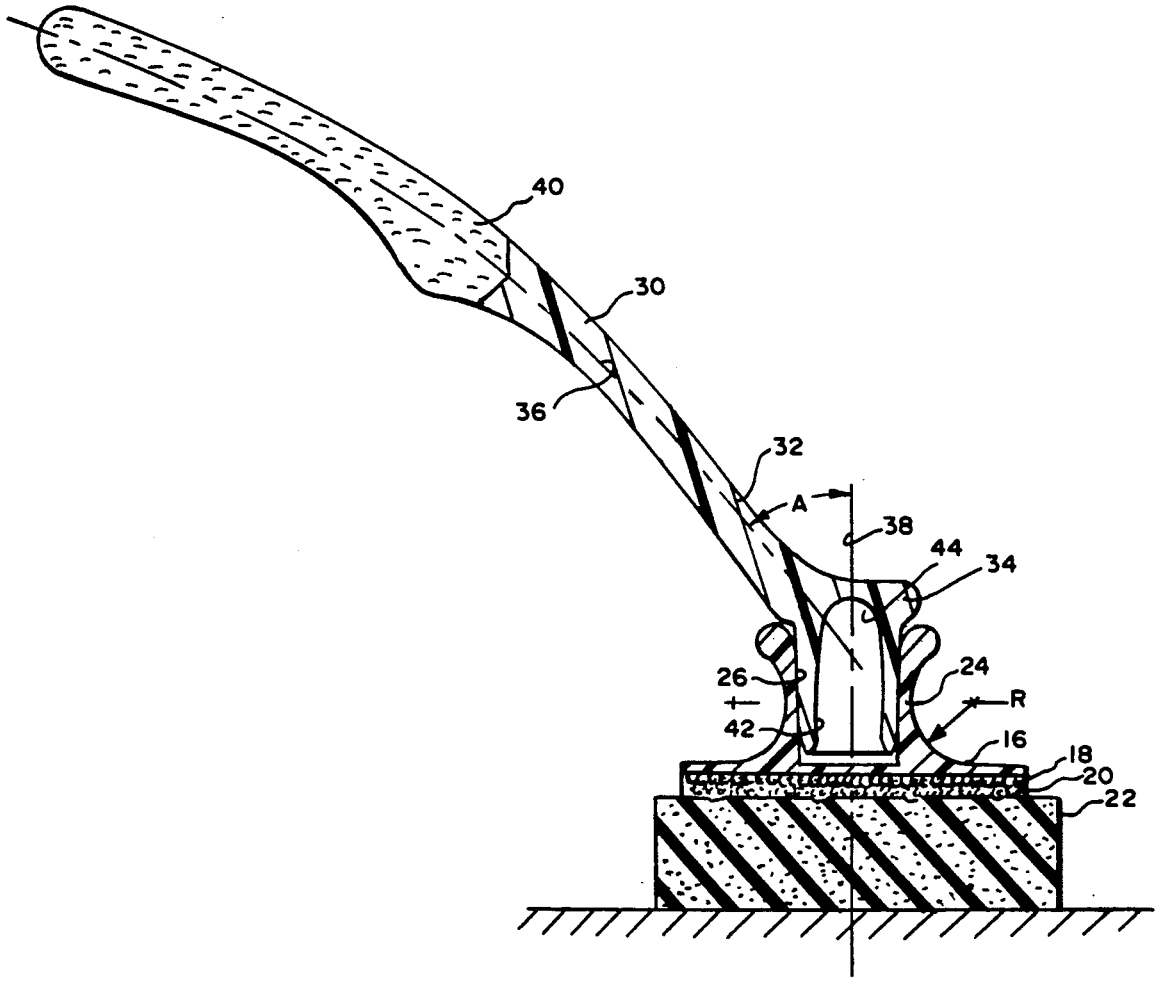
FIG. 8 is a cross-sectional side view of the tool of FIG. 4 with an extension handle added.

Turning to FIG. 8, still another embodiment of the invention is illustrated. In this particular embodiment, an extension handle 30 has been added. Extension handle 30 comprises a generally elongated member 32 and nosed member 34 which is adapted to fit within the aperture 26 in the central member 24 of the base 16. The elongated member has a generally arcuate axis 36. The nose member 34 has generally conical sides and an axis 38 which is disposed at an angle "A" to the axis 36 of the elongated member 32. A good fit is obtained by forming the aperture 26 in the base 16 with a 2 degree taper. Depending on the cleaning task, the extension handle may be either shorter or longer in length or may be at an acute angle, an obtuse angle, or even at right angles to the axis 38 of the knob. The wall thickness "W" of the components or parts of the base 16 should not be more than 0.25 to 0.312 inches, because the plastic will heat-shrink. The free end of the elongated member 32 of the extension handle 30 may be provided with a roughened surface 40 to facilitate gripping with wet or greasy hands. The free end of the nose member 37 preferably has rounded ends 42 and a cored interior 44.

From the foregoing description, it will be observed that numerous variations and modifications may be affected without departing from the true spirit and scope of the novel concept of the invention. For example, the tool need not be limited to use in a kitchen environment or to the cleaning of pots, pans, and common household utensils It may be adapted for use in other places (e.g., bathroom, for personal hygiene, with farm animals and in domestic industry). It need not also be limited to strictly hand operated tools; a power tool, such as a sanding machine or buffer may provide a convenient base for the attachment of the cleaning means. Heavy duty industrial scrubbing, by hand or by machine, are also anticipated uses. Finally, the cleaning means 22 need not be in the form of a flat right cylinder; it may be in the form of a torus (See "T" of FIG. 1) or have an open center (See "C" in FIG. 3). It is, of course, intended to cover by the appended claims all such modifications as fall within the scope of the claims.

I claim:

1. A kitchen utensil, comprising:

(a) a long-lasting, high impact, injection molded generally circular plastic handle which has a shaped side which is contoured with a circumferential, exterior, circular channel to receive at least part of a thumb and a finger of a human hand and which has a smooth surfaces frusto-conical central bore to receive removable means for extending said plastic handle, said plastic handle having one substantially flat surface which is located generally opposite to said shaped side, said removable means having an end with a smooth exterior which is adapted to frictionally fit within said bore, said end of said removable means having an inwardly tapered interior aperture and having almost vertical exterior walls; and (b) a plurality of hook-like elements, adhesively carried by said flat surface of said handle, for removably attaching a cleaning head formed from a plurality of looped members which are adapted to be received by at least one of said hook-like elements.

2. Apparatus, comprising: a base having on one side a generally flat surface and on the other side a handle which has a rounded peripheral channel which is adapted to receive at least a thumb and finger of a human hand and which has an aperture with almost vertical walls to receive means for extending said handle, said flat surface carrying a plurality of small hooks which are adapted to removably capture a plurality of loops carried by a sponge-like cleaning means.

* * * * *